US007662029B2

(12) United States Patent
Arias Lopez

(10) Patent No.: US 7,662,029 B2
(45) Date of Patent: Feb. 16, 2010

(54) CASING-UNFOLDING MODULE FOR THE AUTOMATIC STUFFING OF MEAT PRODUCTS

(75) Inventor: Juan Arias Lopez, Pamplona (ES)

(73) Assignee: Viscofan, S.A., Pamplona (Navarra) (ES)

( * ) Notice: Subject to any disclaimer, the term of this patent is extended or adjusted under 35 U.S.C. 154(b) by 0 days.

(21) Appl. No.: 10/570,782

(22) PCT Filed: Sep. 4, 2003

(86) PCT No.: PCT/ES03/00448

§ 371 (c)(1),
(2), (4) Date: Feb. 5, 2007

(87) PCT Pub. No.: WO2005/023653

PCT Pub. Date: Mar. 17, 2005

(65) Prior Publication Data

US 2007/0202787 A1 Aug. 30, 2007

(51) Int. Cl.
*A22C 11/02* (2006.01)

(52) U.S. Cl. ..... 452/35; 452/34

(58) Field of Classification Search ..... 452/21–26, 452/30, 32–35, 38

See application file for complete search history.

(56) References Cited

U.S. PATENT DOCUMENTS

| | | | | | |
|---|---|---|---|---|---|
| 3,140,509 | A | | 7/1964 | Müller | |
| 3,594,855 | A | * | 7/1971 | Urbutis | 452/29 |
| 3,594,857 | A | * | 7/1971 | Michl | 452/25 |
| 3,745,610 | A | * | 7/1973 | Urbutis | 452/28 |
| 3,936,909 | A | * | 2/1976 | Carter | 452/29 |
| 4,505,003 | A | | 3/1985 | Becker et al. | |
| 4,550,472 | A | * | 11/1985 | Temple et al. | 452/24 |
| 4,577,370 | A | * | 3/1986 | Kollross | 452/22 |
| 4,590,749 | A | * | 5/1986 | Temple et al. | 452/24 |
| 4,649,601 | A | * | 3/1987 | Kollross | 452/22 |
| 4,670,942 | A | * | 6/1987 | Townsend | 452/37 |
| 4,683,615 | A | * | 8/1987 | Tomczak et al. | 452/24 |
| 4,771,510 | A | | 9/1988 | Kawai | |
| 4,924,552 | A | * | 5/1990 | Sullivan | 452/24 |
| 5,038,832 | A | * | 8/1991 | Mahoney et al. | 138/109 |
| 5,211,599 | A | * | 5/1993 | Stanley | 452/37 |
| 5,215,495 | A | * | 6/1993 | Crevasse | 452/21 |
| 5,600,308 | A | * | 2/1997 | Corpeny et al. | 340/675 |
| 6,669,545 | B1 | * | 12/2003 | Hergott et al. | 452/33 |

FOREIGN PATENT DOCUMENTS

| | | | |
|---|---|---|---|
| DE | 667879 | A | 11/1937 |
| ES | 2178559 | A1 | 12/2002 |
| ES | 2188389 | A1 | 6/2003 |
| WO | WO 9730595 | A1 | 8/1997 |

* cited by examiner

*Primary Examiner*—David J Parsley
(74) *Attorney, Agent, or Firm*—Knobbe Martens Olson & Bear LLP

(57) ABSTRACT

Employed in a casing applicator (13) for stuffing of meat products which is mounted on a stuffing tube (3) through which the meat mass is displaced coming from a stuffing machine (4) toward a clipping device (5), a supporting tube (2) through which a casing (1) travels, it consists of a pair of unshirring wheels (8) which pull the previously shined casing (1) on the supporting tube (2) taking it to the end of the supporting tube (2), being complemented with a ring (9) on the external surface of which the casing slides, incorporating a robot (12) which controls the speed and working of the servo-motors associated with the unshirring wheels and actuates the pneumatic cylinders for positioning the wheels on the casing.

21 Claims, 2 Drawing Sheets

CASING-UNFOLDING MODULE FOR THE AUTOMATIC STUFFING OF MEAT PRODUCTS

OBJECT OF THE INVENTION

The present invention relates to a module for unshirring a casing for the automatic stuffing of meat products.

It is an object of the invention that the unshirring module incorporates a mechanism which facilitates the unshirring without resistance from the casing, previously shirred, during the procedure of stuffing the meat product.

It is also an object of the invention that the operation of this module controls the working and the speed of the unshirring operation and is synchronized with a stuffing machine and, in the event, with a tying appliance and/or a clipping device.

BACKGROUND OF THE INVENTION

The use of shirred casings in the stuffing of meat products constitutes a technological advance which allows a high level of automation in the filling processes. The shirred casings are ready for use without any type of prior manipulation and they can be loaded quickly and simply in the feed units. Due to the great amount of compressed casing that each shirred stick contains, the operation reaches a high degree of autonomy and dead time is minimized.

However, the pressure to which the casings are subjected by being shirred, in combination with certain additives used to provide cohesion in the sticks, confer on the casing an appreciable resistance to unshirring in order to be filled. This resistance is specially important in the case of elastic casings, such as nets, whose resistance to flowing toward the mouth of the filling tube is increased by the friction with the surface of the tube on which they are supported, and which increases as the process of consuming the casing stick advances, since the length of the bare tube on which the casing is rubbing is increasing.

This resistance of the shirred casings to be unshirred for their use interferes with the mechanisms for control of the filling pressure making this increasingly difficult. The control of the pressure at which the filling operation is carried out is responsible for the uniformity in the diameter of the products, for its length in the event of portions of a certain volume being stuffed, and for the absence of air inside the products, causing among other effects, defects of a visual nature and problems with the chemical and biological alteration of the sausages.

The control of the filling pressure is carried out by means of systems which brake the casing at the end of the filling tube and the regulation of which is conditioned by the feeding pressure of the product. In all cases, this control is revealed to be very sensitive to any variation in the resistance to the unshirring of the casing, hence by eliminating this resistance, the variation thereof is eliminated automatically. The best way of doing so, is to continuously provide the regulation system (brake) with the casing completely unshirred.

DESCRIPTION OF THE INVENTION

The present invention relates to a module for unshirring casing for automatic stuffing of meat products which satisfactorily resolves the problem outlined above.

With this objective the unshirring module consists fundamentally of a pair of unshirring wheels which impinge on the casing of the product to be stuffed, which is shirred previously and mounted on a supporting tube, the purpose being to pull the casing and draw it to the end of the supporting tube, being complemented with a ring coupled on the supporting tube which assists in untangling for possible shortcomings in the prior operation of shirring the casing.

It is therefore a matter of facilitating the unshirring of the casing leaving it in a layer at the end of the supporting tube so that it can be delivered for stuffing without hardly any resistance.

The module can incorporate a robot which allows the speed of the unshirring wheels to be controlled and to actuate some pneumatic cylinders for positioning the wheels on the supporting tube, which will facilitate the contact of the wheels with the tube or will retract them to be able to remove or to mount the supporting tube. In addition, this robot allows a synchronization to be established with a stuffing machine and, in the event, a tying appliance and/or a clipping device which will work automatically in correspondence with this module.

The module also allows housing of the electric system and the electronic control system of the robot, and also it can constitute the physical support on which the casing applicator rests.

The unshirring module can be mounted in an installation where its operation is synchronized with the operation of a stuffing machine and/or a tying appliance and/or a clipping device.

DESCRIPTION OF THE DRAWINGS

To complete the description being made and in order to assist in a better understanding of the characteristics of the invention, in accordance with a preferred example of practical embodiment, this description is accompanied, as an integral part of the same, with a set of drawings by way of illustration but without restricting, in which the following has been represented.

PREFERRED EMBODIMENT OF THE INVENTION

Figure 1:
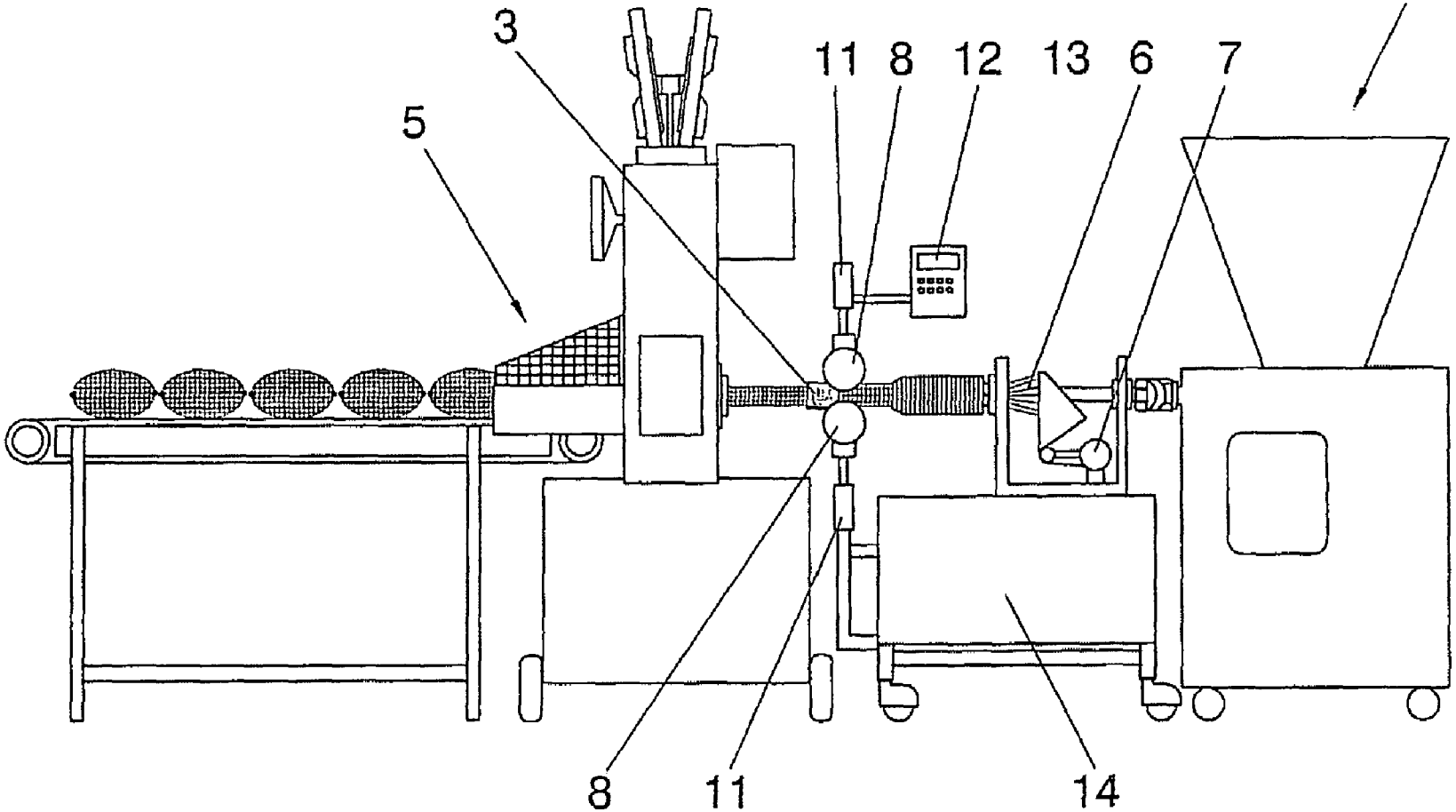
FIG. 1.—It shows a view of the casing unshirring module integrated in an automatic stuffing device of meat products in double sheet and net casing, mounted between the stuffing machine and the clipping device and supporting the double casing applicator.
Figure 2:
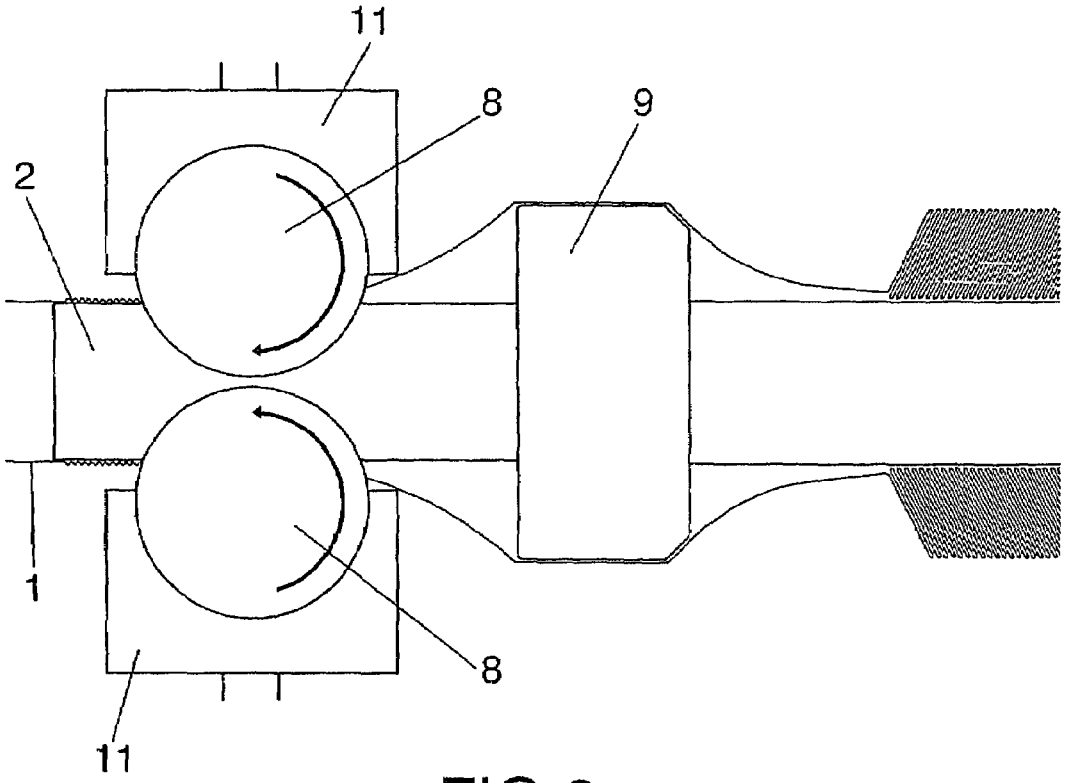
FIG. 2.—It shows a detail of the unshirring of the casing with the help of the wheels.
Figure 3:
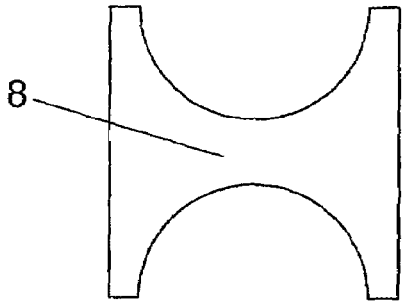
FIG. 3.—It shows a preferred embodiment of the design of the unshirring wheels, in grooved form.

The unshirring module for automatic stuffing of meat products which constitutes the object of this invention, is of application in the casing (1) of the product to be stuffed previously shirred and placed on a supporting tube (2) mounted in an applicator (13) of the casing, in which also a stuffing tube (3) is mounted through which the meat mass is displaced coming from a stuffing machine (4), the ends of the casing finally being clipped by means of a clipping device (5).

The unshirring module consists fundamentally of a pair of unshirring wheels (8) facing each other which contact on the casing previously shirred and placed on the supporting tube (2) and rotate to pull the casing (1) to take it to the end of the supporting tube (2), being complemented with a ring (9) coupled on the supporting tube (2), on the external surface of which the casing (1) slides and is extended favouring the untangling which could have been produced by possible shortcomings in the previous shirring operation.

The unshirring wheels (8) are driven by corresponding servo-motors mounted in respective supports on which impinge the rods of some pneumatic cylinders (11) for positioning the wheels (8) on the casing (1) placed on the supporting tube (2).

Also the module incorporates a robot (12) which automatically synchronizes the operation of the module with the operation of the stuffing machine (4) and the clipping device (5), controls the speed and working of the servo-motors associated with the unshirring wheels (8) and actuates the pneumatic cylinders (11) for positioning the wheels on the casing placed on the supporting tube (2).

The module incorporates a trolley (14) which supports the assembly formed by the unshirring wheels (8) with their servo-motors and pneumatic cylinders (11), houses the electric system and the electronic system for control of the robot (12) and is constituted in a physical support on which the casing applicator (13) stands.

The invention claimed is:

1. Module for unshirring casing for automatic stuffing of meat products comprising:

a supporting tube, adapted to hold shirred casing on a first portion thereof;

a ring, mounted on said supporting tube;

a pair of unshirring wheels spaced laterally from said ring along said supporting tube, wherein the unshirring wheels are configured and positioned to contact the external surface of the casing, and rotate to pull the casing over the external surface of the ring, then through the lateral space between the wheels and the ring, then between the wheels and the supporting tube, and then off the end of the supporting tube, as the easing is unshirred.

2. Module for unshirring casing for automatic stuffing of meat products according to claim 1, wherein the unshirring wheels have a grooved form.

3. Module for unshirring casing for automatic stuffing of meat products according to claim 1 wherein the unshirring wheels are driven by corresponding servo-motors mounted on respective supports on which at least one rods of at least one pneumatic cylinders impinges for positioning the wheels on the casing.

4. Module for unshirring casing for automatic stuffing of meat products according to claim 1, wherein said module comprises a robot which controls the speed and working of at least one servo-motors associated with the unshirring wheels and actuates at least one pneumatic cylinders for positioning the wheels on the casing.

5. Module for unshirring casing for automatic stuffing of meat products according to claim 4, wherein said module is synchronized with a stuffing machine.

6. Module for unshirring casing for automatic stuffing of meat products according to claim 4, wherein said module is synchronized with a tying appliance.

7. Module for unshirring casing for automatic stuffing of meat products according to claim 4, wherein said module is synchronized with a clipping device.

8. Module for unshirring casing for automatic stuffing of meat products according to claim 4, said module comprising a trolley which supports the assembly formed by the unshirring wheels with their servo-motors and their pneumatic cylinders, houses the electric system and the electronic system for control of the robot, and is constituted in a physical support on which a casing applicator stands.

9. Module for unshirring casing for automatic stuffing of meat products according to claim 2, wherein the unshirring wheels are driven by corresponding servo-motors mounted on respective supports on which at least one rod of at least one pneumatic cylinders impinges for positioning the wheels on the easing.

10. Module for unshirring casing for automatic stuffing of meat products according to claim 2, wherein said module comprises a robot which controls the speed and working of at least one servo-motor associated with the unshirring wheels and actuates at least one pneumatic cylinders for positioning the wheels on the casing.

11. Module for unshirring casing for automatic stuffing of meat products according to claim 3, wherein said module comprises a robot which controls the speed and working of the servo-motors associated with the unshirring wheels and actuates the at least one pneumatic cylinder for positioning the wheels on the casing.

12. Module for unshirring easing for automatic stuffing of meat products according to claim 5, wherein said module is synchronized with a tying appliance.

13. Module for unshirring casing for automatic stuffing of meat products according to claim 5, wherein said module is synchronized with a clipping device.

14. Module for unshirring casing for automatic stuffing of meat products according to claim 6, wherein said module is synchronized with a clipping device.

15. Module for unshirring casing for automatic stuffing of meat products according to claim 5, said module comprising a trolley which supports the assembly formed by the unshirring wheels with their at least one servo-motors and their at least one pneumatic cylinders, houses the electric system and the electronic system for control of the robot and is constituted in a physical support on which the casing applicator stands.

16. Module for unshirring easing for automatic stuffing of meat products according to claim 6, said module comprising a trolley which supports the assembly formed by the unshirring wheels with their at least one servo-motors and their at least one pneumatic cylinders, houses the electric system and the electronic system for control of the robot and is constituted in a physical support on which the casing applicator stands.

17. Module for unshirring easing for automatic stuffing of meat products according to claim 7, said module comprising a trolley which supports the assembly formed by the unshirring wheels with their at least one servo-motors and their at least one pneumatic cylinders, houses the electric system and the electronic system for control of the robot, and is constituted in a physical support on which a casing applicator stands.

18. The module of claim 1, wherein the ring is positioned to lift the casing off of a segment of tube between the unshirred casing and the wheels.

19. A method for unshirring casing for meat products using the module of claim 1 comprising pulling the shirred casing first over the ring and then into wheels in contact with the outside of the casing and laterally spaced from the ring.

20. The method of claim 19, comprising stuffing a meat product into the casing.

21. The method of claim 20, comprising clipping the casing and tying the ends of the casing.

* * * * *

UNITED STATES PATENT AND TRADEMARK OFFICE

CERTIFICATE OF CORRECTION

PATENT NO. : 7,662,029 B2
APPLICATION NO. : 10/570782
DATED : February 16, 2010
INVENTOR(S) : Juan Arias Lopez It is certified that error appears in the above-identified patent and that said Letters Patent is hereby corrected as shown below:

At page 1, Item 57, Line 7, change "shined" to --shirred--.

At column 3, line 30, in claim 1, change "easing" to --casing--.

At column 3, line 37, in claim 3, change "rods" to --rod--.

At column 3, line 38, in claim 3, change "cylinders" to --cylinder--.

At column 3, line 43, in claim 4, change "motors" to --motor--.

At column 3, line 44, in claim 4, change "cylinders" to --cylinder--.

At column 4, line 3, in claim 9, change "cylinders" to --cylinder--.

At column 4, line 4, in claim 9, change "easing" to --casing--.

At column 4, line 9, in claim 10, change "cylinders" to --cylinder--.

At column 4, line 17, in claim 12, change "easing" to --casing--.

At column 4, line 30, in claim 15, change "motors" to --motor--.

At column 4, line 31, in claim 15, change "cylinders" to --cylinder--.

At column 4, line 32, in claim 15, change "robot" to --robot,--.

At column 4, line 35, in claim 16, change "easing" to --casing--.

At column 4, line 38, in claim 16, change "motors" to --motor--.

Signed and Sealed this

Twenty-third Day of November, 2010

David J. Kappos

David J. Kappos
*Director of the United States Patent and Trademark Office*

At column 4, line 39, in claim 16, change “cylinders” to --cylinder,--.

At column 4, line 40, in claim 16, change “robot” to --robot,--.

At column 4, line 43, in claim 17, change “easing” to --casing--.

At column 4, line 46, in claim 17, change “motors” to --motor--.

At column 4, line 47, in claim 17, change “cylinders” to --cylinder--.